US006715905B2

(12) United States Patent
Smith

(10) Patent No.: US 6,715,905 B2
(45) Date of Patent: Apr. 6, 2004

(54) LIGHTING APPARATUS

(75) Inventor: Anthony Edward Smith, Ilkeston (GB)

(73) Assignee: Birchwood Products Limited, Derbyshire (GB)

( * ) Notice: Subject to any disclaimer, the term of this patent is extended or adjusted under 35 U.S.C. 154(b) by 0 days.

(21) Appl. No.: 10/174,142

(22) Filed: Jun. 17, 2002

(65) Prior Publication Data

US 2003/0231502 A1 Dec. 18, 2003

(51) Int. Cl.[7] ..... F21V 21/20

(52) U.S. Cl. ..... 362/401; 362/217; 362/260; 362/269

(58) Field of Search ..... 362/401, 269, 362/260, 227, 410, 414, 296, 217, 287; 248/162.1, 364, 910

(56) References Cited

U.S. PATENT DOCUMENTS

| | | | | | |
|---|---|---|---|---|---|
| D273,140 | S | * | 3/1984 | Mann | D26/93 |
| D290,885 | S | * | 7/1987 | Morita | D26/110 |
| 5,065,292 | A | * | 11/1991 | Aubrey | 362/260 |
| 5,381,325 | A | | 1/1995 | Messana | 362/410 |
| 5,490,051 | A | * | 2/1996 | Messana | 362/401 |
| 5,590,956 | A | | 1/1997 | Messana et al. | 362/410 |

FOREIGN PATENT DOCUMENTS

| | | |
|---|---|---|
| CA | 2115095 | 8/1994 |
| GB | 313174 | 7/1930 |
| GB | 1 603 824 | 12/1981 |
| WO | 95/31352 | 11/1995 |

* cited by examiner

*Primary Examiner*—Sandra O'Shea
*Assistant Examiner*—Ali Alavi
(74) *Attorney, Agent, or Firm*—Smith-Hill and Bedell

(57) ABSTRACT

Lighting apparatus includes a self righting base to return the apparatus to an upright condition when tipped therefrom. The apparatus also includes a lighting assembly mountable on the base. The lighting assembly includes an upwardly extending elongate light transmitting means, which has a light transmitting region through which light can be transmitted. The length of the light transmitting region is greater than the height of the base.

16 Claims, 2 Drawing Sheets

LIGHTING APPARATUS

In the construction and other industries, it is often necessary to provide illumination in areas where work is being carried out. The lamps for providing such illumination generally consist of a stand which carries a suitable lighting assembly. If knocked, there is a danger that such lighting apparatus will fall over with the possibility that it could damage not only itself but also any other equipment in the vicinity.

According to one aspect of this invention, there is provided lighting apparatus comprising a self righting base to return the apparatus to an upright condition when tipped therefrom, and a lighting assembly mountable on the base, the lighting assembly comprising an upwardly extending elongate light transmitting means having a light transmitting region through which light can be transmitted, wherein the length of the light transmitting region is greater than the height of the base.

Desirably the height of the light transmitting region is greater than twice the height of the base, preferably greater than three times the height of the base and, more preferably, greater than four times the height of the base. Preferably the light transmitting means comprises a tubular housing member, which may be generally cylindrical, and is advantageously capable of transmitting light therethrough. The lighting assembly may further include elongate light creation means, which may be housed within the housing member. The elongate light creation means may be generally of the same length as the housing member. A reflector may also be provided within the housing member to reflect light in a desired direction. The reflector may be elongate and preferably extends approximately the length of the light creation means. The light creation means may be a fluorescent tube.

The self righting base may comprise a base member to which the lighting assembly can be mounted. The base member may be hollow, and advantageously has a convex curved lower surface. The curved lower surface may be in the form of a segment of a sphere. The base member may comprise a lower face to engage the ground when the apparatus is in an upright position. Said lower face may be substantially planar, and preferably extends generally orthogonal to the lighting assembly.

Lifting means may be provided to allow the apparatus to be lifted. The lifting means may comprise handles extending partially around the base. Preferably, the base defines at least one recess, and the handle may extend across said recess. Preferably, the base defines a pair of opposite recesses with respective handle extending across each recess. Weighting means may be provided within the base, to counterbalance the lighting assembly and return the lighting apparatus to the upright condition when tipped therefrom. The weighting means may be in the form of ballasts, for example sand. Preferably, the light transmitting means extends from said base.

The base preferably has an upper face which may define an aperture to enable the weighting means to be disposed therein.

An embodiment of the invention will now be described by way of example only, in which.

Figure 1:
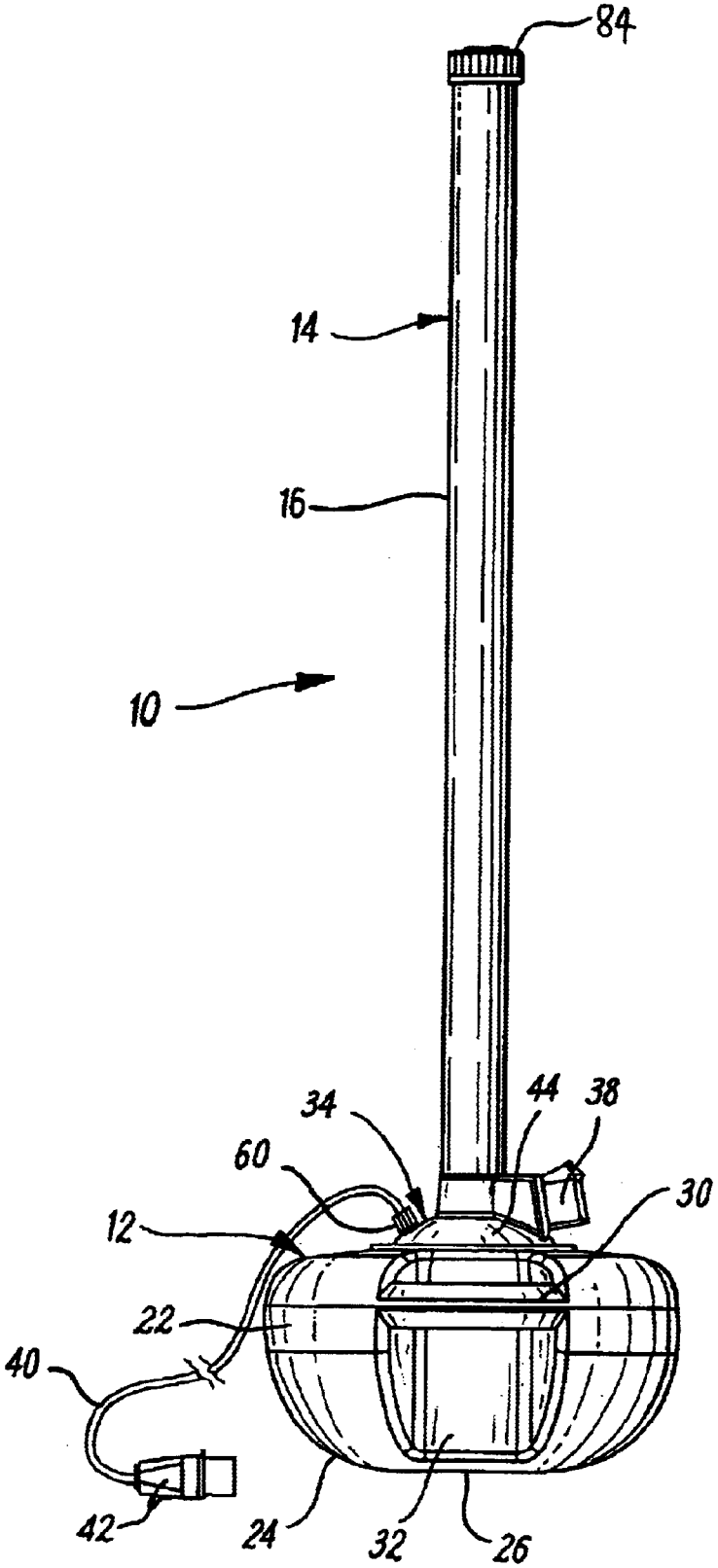
FIG. 1 shows a side view of lighting apparatus.
Figure 2:
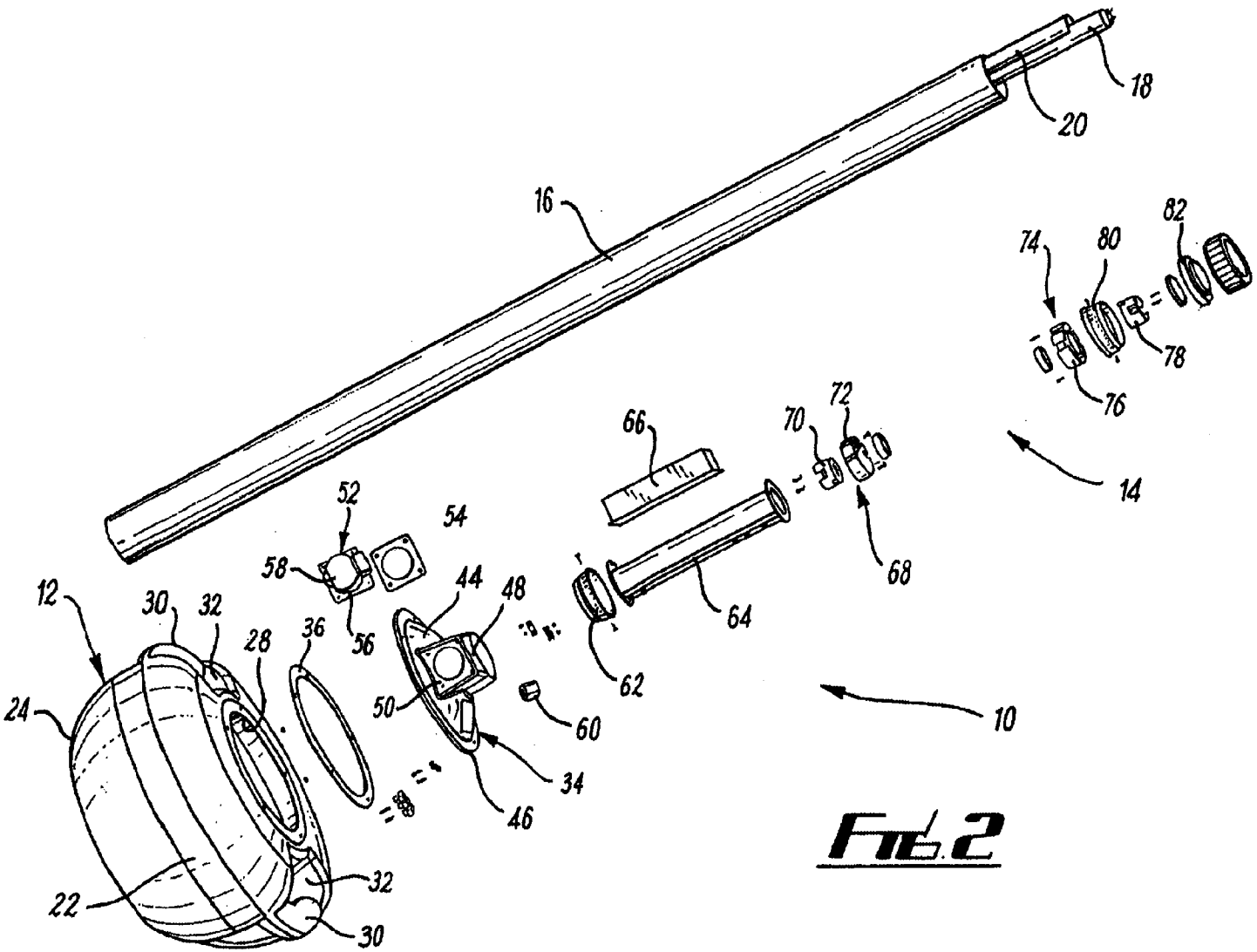
FIG. 2 shows an exploded view of the lighting apparatus shown in FIG. 1.

Referring to the drawings, there is shown lighting apparatus 10 comprising a self righting base 12 and a lighting assembly 14. The lighting assembly 14 comprises light transmitting means in the form of a cylindrical tubular housing member 16 mounted on the base 12. The housing member 16 is formed of a transparent material, for example, a plastics material, such as a polycarbonate material and extends upwardly from the base 12. The length of the housing member 16 is in the region of two to four times the height of the base 12.

The lighting assembly 14 further includes elongate light creation means in the form of a fluorescent tube 18 and an elongate reflector 20 which is curved in its lateral dimension and extends around part of the inside of the housing member 16 to direct light generally in one direction through the housing member 16. The reflector 20 extends substantially the length of the housing member 16.

The self righting base 12 comprises a hollow base member 22 having a convex curved lower surface 24 which is in the form of a segment of a sphere. At the bottom of the lower surface there is provided a generally planar face 26 which engages the ground when the lighting apparatus 10 is in its upright position.

At the top of the base 12 there is defined a circular aperture 28 to allow weighting means to be introduced into the bottom of the base 12. The weighting means can be in the form of sand. Lifting means in the form of handles 30 are arranged opposite each other on the hollow base member 22 of the base 12 and extend across respective recesses 32 defined in the hollow base member 22.

The lighting assembly 14 is provided on the base 12 so that it extends upwardly therefrom. The lighting assembly 14 includes a cover member 34 which extends over the aperture 28 and an annular seal member 36 is provided between the cover member 34 and the base 12.

The cover member 34 comprises a socket 38 to receive plug to allow a plurality of similar lighting apparatus to be connected together in series, or to allow a power tool to be electrically connected thereto An electrical cable 40 extends from the base 12 opposite the socket member 38 to a plug 42 to allow the lighting apparatus 10 to be connected to a source of electricity.

The cover member 34 comprises a domed portion 44 having a circumferentially extending flange 46 to engage over the sealing member 36. A turret member 48 extends upwardly from the domed portion 44 and a socket fixing portion 50 is provided thereon. The socket 38 comprises a socket member 52 and a sealing member 54 received between the socket member 52 and the fixing portion 50. The socket member 52 is a standard socket member comprising a receiving part 56 for receiving an electrical plug therein to effect electrical connecting, and a flap 58 hingedly mounted on the receiving part 56. Cable guide means 60 is provided on the domed portion 44 to guide the cable 40 to which the plug 42 is connected. The cable guide means 60 being threadably secured within a suitably threaded aperture in the domed portion 44.

A lower annular threaded connecting member 62 is threadably received in the open top of the turret member 48 and attached thereto is a fluorescent tube holding element 64. The cylindrical housing member 16 is mounted over the holding element 64 and is received in the lower connecting member 62. The holding element 64 is provided to house a ballast 66 to ensure that the correct voltage is transmitted from the mains supply of electricity to the fluorescent tube 18 and to provide a suitable starting voltage for the fluorescent tube 18.

A connection assembly 68 is provided on the holding element 64 to hold the lower end of the fluorescent tube 18 in place and to effect an electrical connection to the fluorescent tube 18. The lower connection assembly 68 comprises a lower electrical contact member 70 to effect electrical contact between the lower end of the fluorescent tube 18 and the electrical components. The lower connection assembly 68 also includes a lower tube holder 72 to hold the fluorescent tube 18 in position on the electrical contact member 70.

The reflector 20, which is formed of a suitable metallic material, e.g. aluminium, is in electrical connection with the lower electrical contact member 70 at the lower end of the housing member 16 and extends upwardly, with the fluorescent tube to an upper connection assembly 74 which comprises an upper tube holder 76, and an upper electrical contact member 78. The upper end of the reflector 20 is held within the upper electrical contact member 78.

An upper threaded annular connecting member 80 is provided on the upper end region of the housing member 16, which is received within the upper connecting member 80. Cap means 82 is provided over the top of the housing member 16 and is secured in place by an annular threaded cover member 84 which is threadably received on the upper connecting member 80.

The opposite end regions of the housing member are secured to the upper and lower connecting members 62, 80 by suitable means, for example, an adhesive. In use, the lighting apparatus 10 is provided with the lighting assembly 14 already assembled, together with appropriate fluorescent tube 18. The user provides an appropriate amount of the weighting means for example sand in the bottom of the base 12 and then attaches thereto the lighting assembly 14 by means of suitable fastening means for example screws to fasten the cover member 34 to the base 12. The lighting apparatus 10 is then connected to mains electricity by means of the plug 42 and a plurality of lighting apparatus 10 can be arranged in series, for example to illuminate a long corridor by plugging the plug of subsequent adjacent lighting apparatus into said lighting apparatus 10.

In the event that the lighting apparatus is inadvertently knocked while in use, the apparatus will tilt by up to 45°, but is prevented from completely falling over by the weighting means in the base 12 which counter balances the weight of the lighting assembly 14. The curved lower surface 24 of the base 12 causes the lighting apparatus 10 to return to its upright position. This self righting ability of the lighting apparatus 10 has the advantage that it is not damaged when knocked, because any knock will simply cause the apparatus to tilt return to its upright position, thereby preventing damage to the lighting assembly 14.

Various modifications can be made without departing from the scope of the invention, for example the housing member 16 could be formed of transparent materials other than polycarbonate, and the electrical connection between the upper and lower ends of the tube need not be affected by the reflector 20, but instead suitable wiring can be used.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. Lighting apparatus comprising a self righting base to return the apparatus to an upright condition when tipped therefrom, and an elongate lighting assembly mountable directly on the base, the lighting assembly comprising an upwardly extending elongate light transmitting means having a light transmitting region through which light can be transmitted, wherein the length of the light transmitting region constitutes a major proportion of the length of the lighting assembly, and the length of the light transmitting region is greater than the height of the base.

2. Lighting apparatus according to claim 1 wherein the length of the light transmitting region is greater than twice the height of the base.

3. Lighting apparatus according to claim 2 wherein the length of the light transmitting region is greater than three times the height of the base.

4. Lighting apparatus according to claim 3 wherein the length of the light transmitting region is greater than four times the height of the base.

5. Lighting apparatus according to claim 1 wherein the light transmitting means comprises a tubular housing member, and the lighting assembly further includes elongate light creation means, housed within the housing member.

6. Lighting apparatus according to claim 5 wherein the elongate light creation means is generally of the same length as the housing member.

7. Lighting apparatus according to claim 6 wherein a reflector is provided within the housing member to reflect light in a desired direction, said reflector being elongate and extending approximately the length of the light creation means.

8. Lighting apparatus according to claim 5 wherein the light creation means comprises a fluorescent tube.

9. Lighting apparatus according to claim 1 wherein the self righting base comprises a base member to which the lighting assembly can be mounted, the base member being hollow, and having a convex curved lower surface.

10. Lighting apparatus according to claim 1 wherein the light transmitting means comprises a tubular housing member mounted directly on the base and extending upwards therefrom and the apparatus further comprises an elongate tubular fluorescent bulb engaging the base and extending upwards therefrom and housed within the housing member.

11. Lighting apparatus according to claim 9 wherein the lower surface is substantially planar and extends generally orthogonal to the light transmitting means.

12. Lighting apparatus according to claim 1 including lifting means may be provided to allow the apparatus to be lifted, the lifting means comprises handles extending partially around the base.

13. Lighting apparatus according to claim 12 wherein the base defines at least one recess, and the handle extends across said recess.

14. Lighting apparatus according to claim 13 wherein the base defines a pair of opposite recesses with a respective handle extending across each recess.

15. Lighting apparatus according to claim 1 comprising weighting means provided within the base to counterbalance the lighting assembly and return the lighting apparatus to the upright condition when tipped therefrom.

16. Lighting apparatus according to claim 15 wherein the base has an upper face which defines an aperture to enable the weighting means to be disposed therein, and at which the lighting assembly can be secured to the base.

* * * * *